US011114024B2

(12) United States Patent
Chen

(10) Patent No.: US 11,114,024 B2
(45) Date of Patent: Sep. 7, 2021

(54) METHOD FOR MAINTAINING LED BRIGHTNESS, LED DRIVING CIRCUIT AND DISPLAY DEVICE

(71) Applicant: Xianyang Caihong Optoelectronics Technology Co.,Ltd, Xianyang (CN)

(72) Inventor: Yuyeh Chen, Xianyang (CN)

(73) Assignee: XIANYANG CAIHONG OPTOELECTRONICS TECHNOLOGY CO., LTD, Xianyang (CN)

( * ) Notice: Subject to any disclaimer, the term of this patent is extended or adjusted under 35 U.S.C. 154(b) by 0 days.

(21) Appl. No.: 17/120,556

(22) Filed: Dec. 14, 2020

(65) Prior Publication Data

US 2021/0183305 A1 Jun. 17, 2021

(30) Foreign Application Priority Data

Dec. 17, 2019 (CN) ..... 201911302724.0

(51) Int. Cl.
*G09G 3/32* (2016.01)
*G09G 5/10* (2006.01)

(52) U.S. Cl.
CPC ..... *G09G 3/32* (2013.01); *G09G 5/10* (2013.01); *G09G 2300/0426* (2013.01); *G09G 2320/0633* (2013.01); *G09G 2360/142* (2013.01); *G09G 2360/148* (2013.01)

(58) Field of Classification Search
None
See application file for complete search history.

(56) References Cited

U.S. PATENT DOCUMENTS

2018/0226016 A1* 8/2018 Suzuki ..... G09F 9/30
2020/0212137 A1* 7/2020 Wang ..... G09G 3/325

* cited by examiner

*Primary Examiner* — Aneeta Yodichkas
(74) *Attorney, Agent, or Firm* — WPAT, PC

(57) ABSTRACT

A method for maintaining LED brightness is provided and exemplarily includes steps of: providing a LED driving circuit capable of performing current detection and compensation; performing a detection based on the LED driving circuit to obtain mapping relationships among current, brightness and voltage; and monitoring a current flowing through a LED driven by the LED driving circuit, and performing a compensation according to the monitored current and the mapping relationships to maintain brightness of the LED. Moreover, a LED driving circuit is also provided and includes first through fourth transistors and a capacitor. In addition, a display device adopting the method for maintaining LED brightness or the LED driving circuit is also provided.

16 Claims, 5 Drawing Sheets

METHOD FOR MAINTAINING LED BRIGHTNESS, LED DRIVING CIRCUIT AND DISPLAY DEVICE

TECHNICAL FIELD

The disclosure relates to the field of display technologies, and more particularly to a method for maintaining LED brightness, a driving circuit and a display device.

DESCRIPTION OF RELATED ART

In recent years, the mini-LED field has attracted much attention in the display industry, and a large number of domestic and foreign manufacturers are optimistic about its market prospects and are rushing to research. In the display field, two major application directions of mini-LED, such as a mini-LED display panel of small pitch display devices and a mini-LED backlight module of a liquid crystal display (LCD) device, have become the most popular topics in the year of 2019.

A small pitch LED based device refers to a LED backlight module or a LED display panel where a pitch between adjacent LED lamps is less than 2.5 mm. Compared with a traditional backlight module, a small pitch LED backlight module has more concentrated light-emitting wavelengths, faster response speed and longer service life, and a system light loss can be reduced from 85% being the traditional backlight module to be 5%. Compared with a traditional LED display panel, a small pitch LED display panel has advantages of high brightness, high contrast, high resolution, high color saturation, as well as seamlessness splicing and long service life, and thus has broad application prospects in fields such as film and television entertainment, shopping and retail, culture and education, security monitoring, and public advertising.

A mini-LED based device is a small pitch LED product with a pitch between 2.5 mm and 0.1 mm, which in one aspect can directly use a RGB three-color LED module to achieve the display effect of RGB three primary colors of lossless, can cover a wide color gamut of 100% BT2020, and its vividness of color is comparable to that of an OLED. Moreover, it can achieve uniform heat dissipation under high brightness (>1000 nit) that is difficult for traditional discrete LED device solutions. In another aspect, the mini-LED based device can realize a direct-type ultra-thin LCD display, namely OD≈0 mm, which has wide applications in slim and lightweight portable consumer electronics, such as AR/VR glasses, mobile phones, laptops, etc. In addition, combined with a fine local dimming technology, it can achieve ultra-high contrast (1000000:1), make blacks deeper and whites brighter, and thus is suitable for high-end display solutions. On the one hand, it can be used as a direct-lit backlight source of a liquid crystal display device to obtain mainstream market applications, such as mobile phones, TVs, car panels and laptops; and on the other hand, it is expected to derive high-end backlight-type products to compete with high-end OLED products. It is estimated that, under the same contrast condition, an LCD panel equipped with the mini-LED backlight module may have a price only being 70%-80% of that of an OLED panel, and the image display effect of LCD device is greatly improved.

The mini-LED is a current-driven light-emitting component. There are generally two driving modes that: PM driving type (PM: passive matrix, also known as passive matrix addressing type) and AM driving type (AM: active matrix, also known as active matrix addressing type). In a circuit design of the AM driving type, each mini-LED pixel has its own independent driving circuit, and a driving current is provided by a driving transistor. The driving circuit for each pixel basically uses at least two transistors to control an output current, since its essence is a voltage-controlled current source and the mini-LED pixel is a current-driven type component, it will bring a certain degree of difficulty in controlling the LED display brightness. Therefore, how to maintain the display brightness of mass-produced AM driving type mini-LEDs after long-term use has become a problem difficult to overcome.

SUMMARY

In order to overcome at least some of shortcomings and deficiencies in related arts, an embodiment of the disclosure provides a method for maintaining LED brightness including steps of:

providing a LED driving circuit capable of performing current detection and compensation;

performing a detection based on the LED driving circuit to obtain mapping relationships among current, brightness and voltage; and monitoring a current flowing through a LED driven by the LED driving circuit, and performing a compensation according to the monitored current and the mapping relationships to maintain brightness of the LED.

In an embodiment of the disclosure, the step of performing a detection based on the LED driving circuit to obtain mapping relationships among current, brightness and voltage is carried out at the factory; the step of monitoring a current flowing through a LED driven by the LED driving circuit is carried out in real-time during the LED driving circuit is working; the mapping relationships include a mapping relationship between current and brightness and a mapping relationship between voltage and current; and a process of the LED being aged along with the increase of working time has a mapping relationship between brightness and time.

In an embodiment of the disclosure, the method for maintaining LED brightness is applied to a mini-LED based display device and for driving and compensating brightness of each LED or each mini-LED pixel of the mini-LED based display device; data representing the mapping relationship between current and brightness and data representing the mapping relationship between brightness and time are stored in a memory of the mini-LED based display device; the step of performing a compensation according to the monitored current and the mapping relationships to maintain brightness of the LED is carried out in a manner of voltage adjustment after reading the data stored in the memory, comparing and calculating; and the mini-LED based display device includes a mini-LED display panel or a mini-LED backlight module of a liquid crystal display device.

In another aspect, an embodiment of the disclosure provides a LED driving circuit including: a first transistor, a second transistor, a third transistor, a fourth transistor and a capacitor. A drain of the first transistor and one terminal of the capacitor are electrically connected to a first reference node. A source of the second transistor, a gate of the first transistor and the other terminal of the capacitor are electrically connected to a second reference node. A source of the first transistor, a source of the third transistor and a source of the fourth transistor are electrically connected to a third reference node. A gate of the second transistor and a gate of the third transistor are electrically connected to a fourth reference node. A drain of the second transistor is electrically connected to a data signal input terminal. A drain of the third transistor is electrically connected to a detection signal receiving terminal. A drain of the fourth transistor is electrically connected to a detection current input terminal, and a gate of the fourth transistor is electrically connected to a detection control voltage terminal. The fourth reference node is electrically connected to a scan signal input terminal. A LED is driven by the first transistor.

In an embodiment of the disclosure, a brightness detector is arranged beside the LED, the LED is a mini-LED, the LED driving circuit is applied to a mini-LED based display device, and the mini-LED based display device includes a mini-LED display panel or a mini-LED backlight module of a liquid crystal display device.

In an embodiment of the disclosure, the first reference node is electrically connected to a voltage signal input terminal, the third reference is electrically connected to an anode of the LED, and a cathode of the LED is electrically connected to a common ground electrode.

In an embodiment of the disclosure, the first reference node, the source of the third transistor and the source of the fourth transistor are electrically connected to the third reference node. The third reference node is electrically connected to a cathode of the LED, and an anode of the LED is electrically connected to a voltage signal input terminal. The source of the first transistor is electrically connected to a common ground electrode.

In an embodiment of the disclosure, the LED driving circuit is performed with a current detection before leaving factory to obtain a mapping relationship between current and brightness. The current detection includes: after the mini-LED based display device is produced, the fourth transistor of the LED driving circuit is used to acquire the mapping relationship between current and brightness. During the brightness detector is used to detect brightness of the LED, signals on the detection control voltage terminal and the scan signal input terminal are at logic high levels respectively, a signal on the data signal input terminal is at a logic low level, the fourth transistor is turned on, the LED driving circuit controls a current source outputs currents to flow through the LED, and meanwhile the brightness detector measures data of brightness of the LED, and thereby the mapping relationship between current and brightness and a mapping relationship between voltage and current are obtained.

In an embodiment of the disclosure, the LED driving circuit is performed with a real-time monitoring and compensation when it is normally working. The real-time monitoring and compensation include: during the mini-LED based display device is in normal use, the third transistor is used to acquire data of currents of the LED. During the LED driving circuit is normally working, signals on the scan signal input terminal, the data signal input terminal and the voltage signal input terminal are at logic high levels respectively, the first transistor, the second transistor and the third transistor all are turned on, the detection signal receiving terminal pulls out a voltage for calculating brightness of the LED, a controller of the mini-LED based display device meanwhile calculates instant brightness according to a mapping relationship between current and brightness and a mapping relationship between brightness and time, and the controller calculates a target voltage by reading and referring to a mapping relationship between voltage and current and considering the instant brightness and then adjusts a voltage on the voltage signal input terminal according to the target voltage to achieve the compensation.

In still another aspect, an embodiment of the disclosure provides a display device adopting the above described method for maintaining LED brightness or the above described LED driving circuit.

In the method for maintaining LED brightness, the driving circuit and the display device as described above, aiming at the influence of aging of the mini-LED over time, by detecting and storing data representing the mapping relationship between brightness and current, the mapping relationship between brightness and time and so on in the memory of the display device, and then compensating the LED brightness in a voltage compensation manner, which realizes better control of LED display brightness, and thereby realizes the brightness compensation of each LED or each mini-LED pixel and consequently solves the problem of how to maintain the display brightness of the mass-produced AM driving type mini-LEDs after long-term use.

BRIEF DESCRIPTION OF THE DRAWINGS

In order to more clearly illustrate technical solutions of embodiments of the disclosure, drawings used in the description of the embodiments will be briefly described below. Apparently, the drawings described below are merely some embodiments of the disclosure, and those skilled in the art can obtain other drawings based on these drawings without creative efforts.

DETAILED DESCRIPTION OF EMBODIMENTS

Figure 1:
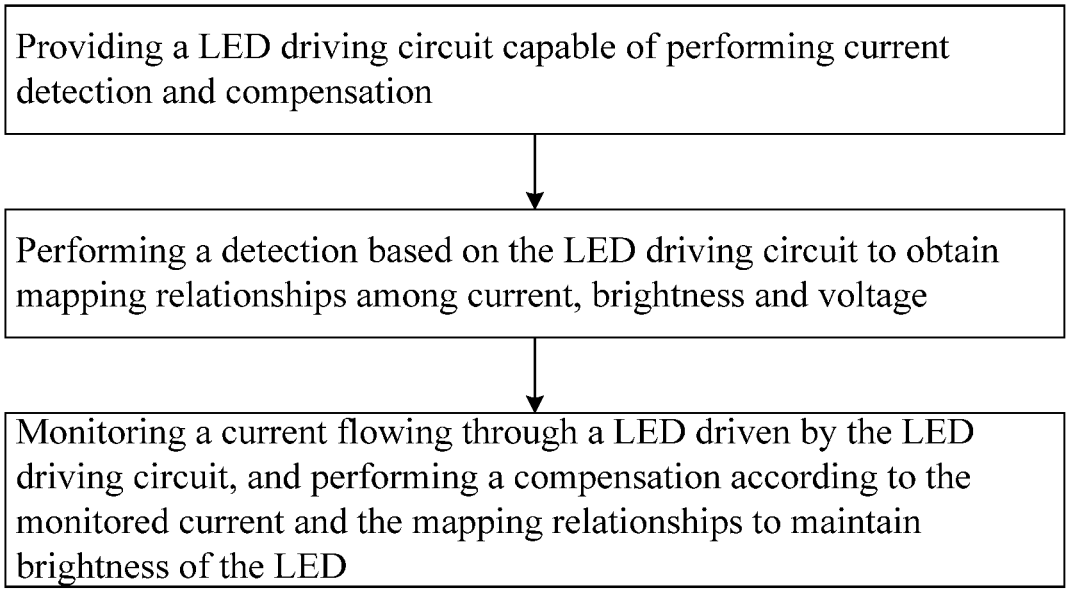
FIG. 1 is a schematic flowchart of a method for maintaining LED brightness according to an embodiment of the disclosure.

In order to make objectives, technical solutions and advantages of embodiments of the disclosure be clearer, the technical solutions in the embodiments of the disclosure will be clearly and completely described below, with reference to the accompanying drawings in the embodiments of the disclosure. Apparently, the described embodiments are merely some of the embodiments of the disclosure, not all embodiments. Based on the described embodiments of the disclosure, all the other embodiments obtained by those skilled in the art without any creativity should belong to the protection scope of the disclosure.

The description of various embodiments in the following refers to the accompanying drawings to illustrate specific embodiments that the disclosure can be implemented. Directional terms mentioned in this disclosure, such as "up", "down", "front", "rear", "left", "right", "inner", "outer" and "side" are only with reference to directions of the accompanying drawings. Therefore, the directional terms are used to illustrate and understand the disclosure, rather than to limit the disclosure.

The drawings and descriptions are to be regarded as illustrative in nature and not restrictive. In the accompanying drawings, units/components with similar structures are indicated by a same reference numeral. For the sake of understanding and ease of description, a size and a thickness of each component shown in the drawings are arbitrarily shown, but the disclosure is not limited thereto.

In addition, in the specification, unless expressly described to the contrary, the word "including" will be understood as meaning including a component(s), but not excluding any other component(s). In this specification, the term "connected" as used may be a physical connection, an electrical connection, a wireless connection or other signal and transmission connection manner, the term "connect" as used are for describing and understanding the disclosure, not to limit the disclosure. In addition, in the specification, "on" means to be located above or below a target component, and does not mean that it must be located on the top based on the direction of gravity.

In order to further explain adopted technical means for realizing intended purposes of the disclosure and effects thereof, in conjunction with the accompanying drawings and preferred embodiments, specific implementations, structures, features and effects of a method for maintaining LED brightness, a driving circuit and a display device according to the disclosure will be described below in detail.

Referring to FIG. 1, FIG. 1 is a schematic flowchart of a method for maintaining LED brightness. The method for maintaining LED brightness according to an embodiment of the disclosure includes: providing a LED driving circuit capable of performing current detection and compensation; performing a detection based on the LED driving circuit to obtain mapping relationships among current, brightness and voltage; and monitoring a current flowing through a LED driven by the LED driving circuit, and performing a compensation according to the monitored current and the mapping relationships to maintain brightness of the LED.

Figure 2:
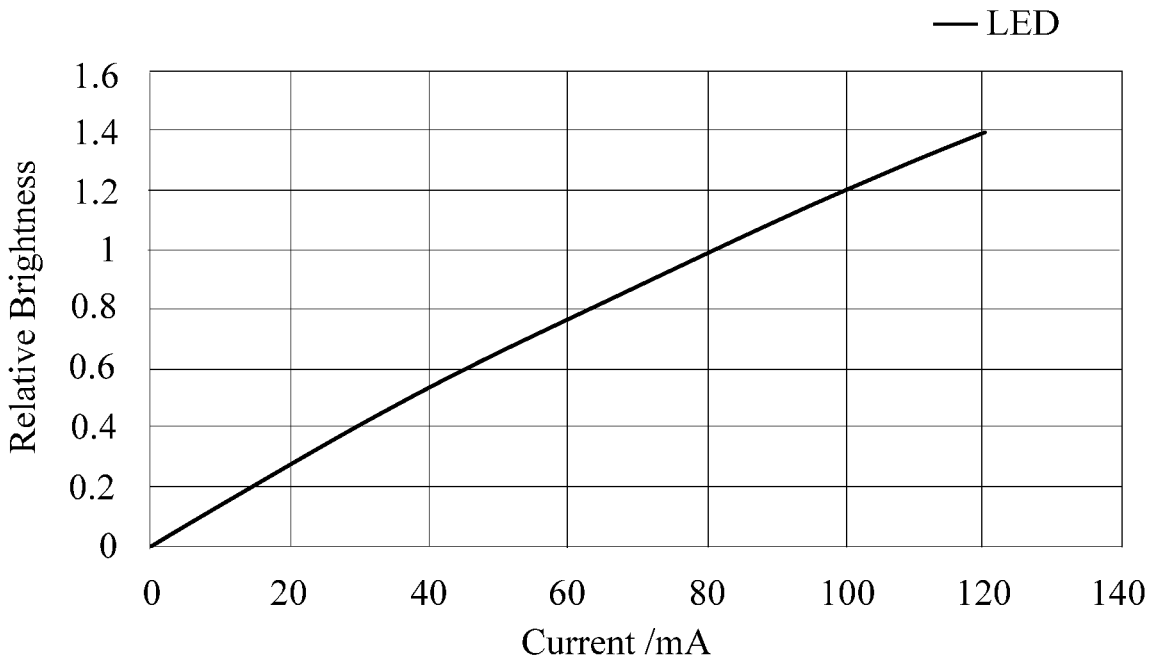
FIG. 2 is a schematic graph showing a mapping relationship between current and brightness according to an embodiment of the disclosure.
Figure 3:
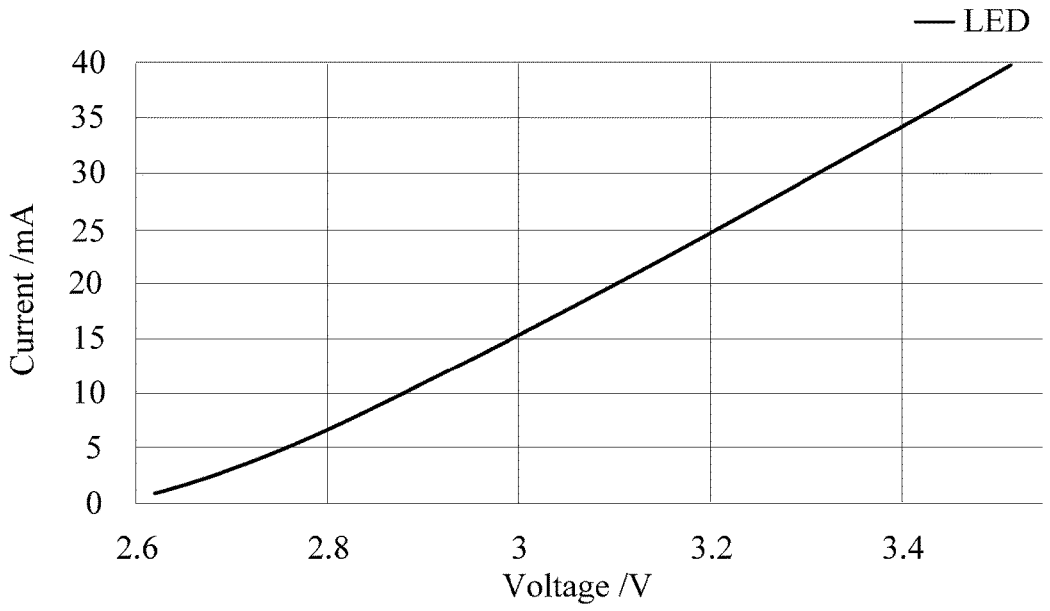
FIG. 3 is a schematic graph showing a mapping relationship between voltage and current according to an embodiment of the disclosure.
Figure 4:
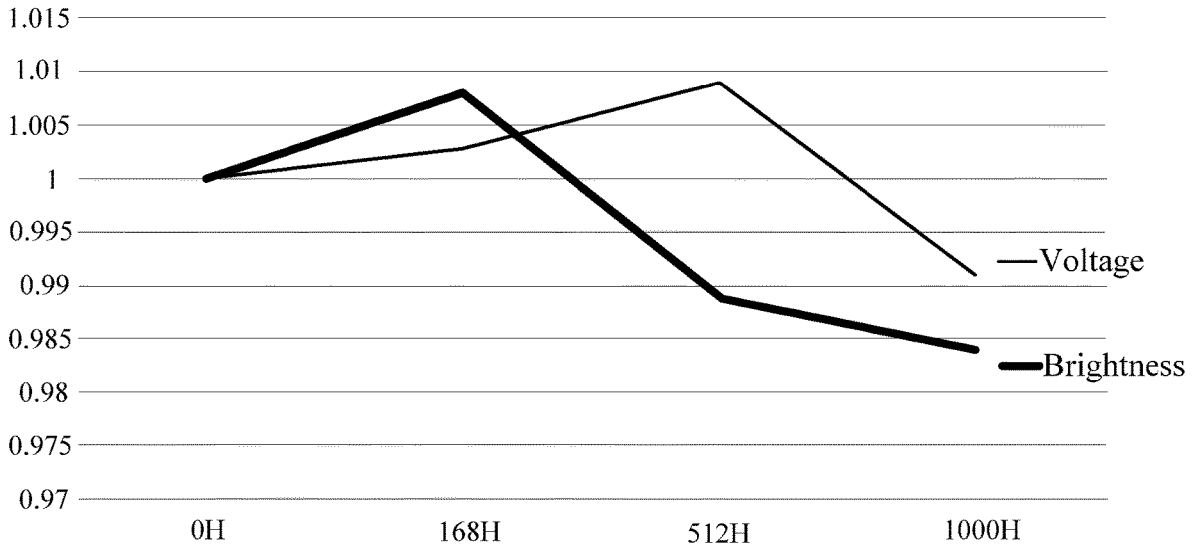
FIG. 4 is a schematic graph showing a mapping relationship among brightness, time and voltage according to an embodiment of the disclosure.

Specifically, referring to FIG. 2, FIG. 3 and FIG. 4, FIG. 2 is a schematic graph showing a mapping relationship between current and brightness according to an embodiment of the disclosure, FIG. 3 is a schematic graph showing a mapping relationship between voltage and current according to an embodiment of the disclosure, and FIG. 4 is a schematic graph showing mapping relationships among brightness, time and voltage according to an embodiment of the disclosure. The detection is exemplarily performed onto a mini-LED based display device at the factory. The monitoring is exemplarily carried out in real time during the driving circuit of the mini-LED based display device is working. The mapping relationships among current, brightness and voltage are, for example, the mapping relationship between current and brightness as illustrated in FIG. 2 and the mapping relationship between voltage and current as illustrated in FIG. 3. Moreover, a process of the LED being aged along with the increase of working time may further have the mapping relationships among brightness, time and voltage as illustrated in FIG. 4. These mapping relationships may be in form of data tables.

Figure 5:
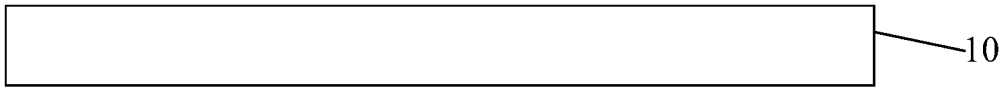
FIG. 5 is a schematic view of a mini-LED based display device according to an embodiment of the disclosure.

Referring to FIG. 5, FIG. 5 is a schematic view of a mini-LED based display device according to an embodiment of the disclosure. The method for maintaining LED brightness according to the embodiment of the disclosure may be applied to the mini-LED based display device 10 such as a mini-LED display panel or a mini-LED backlight module of a LCD, but the disclosure is not limited thereto.

Furthermore, the method for maintaining LED brightness drives and compensates the brightness of each LED or each mini-LED pixel of the display device 10. The display device 10 may include a controller, a memory and a driving circuit of each LED. Data representing the mapping relationship between current and brightness shown in FIG. 2, the mapping relationship between brightness and time shown in FIG. 4 and so on may be stored in the memory of the display device 10. The compensation is performed in a manner of adjusting a voltage by the driving circuit, after reading the data stored in the memory, comparing and calculating.

Figure 6:
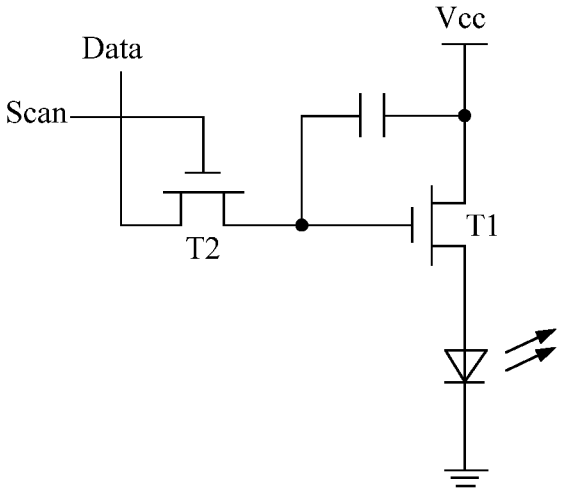
FIG. 6 is a schematic diagram of a 2T1C driving circuit of an AM mini-LED according to an embodiment of the disclosure.
Figure 7:
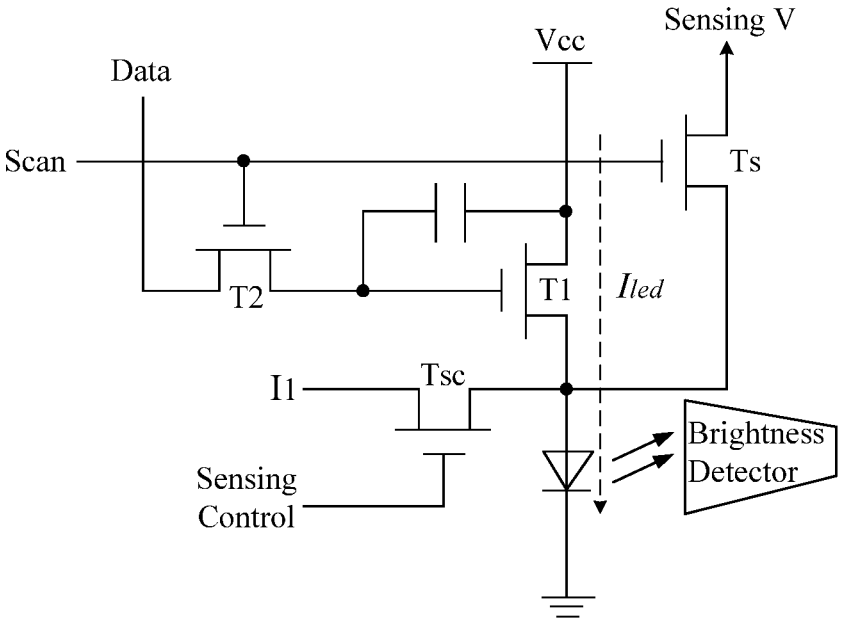
FIG. 7 is a schematic diagram of a LED driving circuit according to an embodiment of the disclosure.
Figure 8:
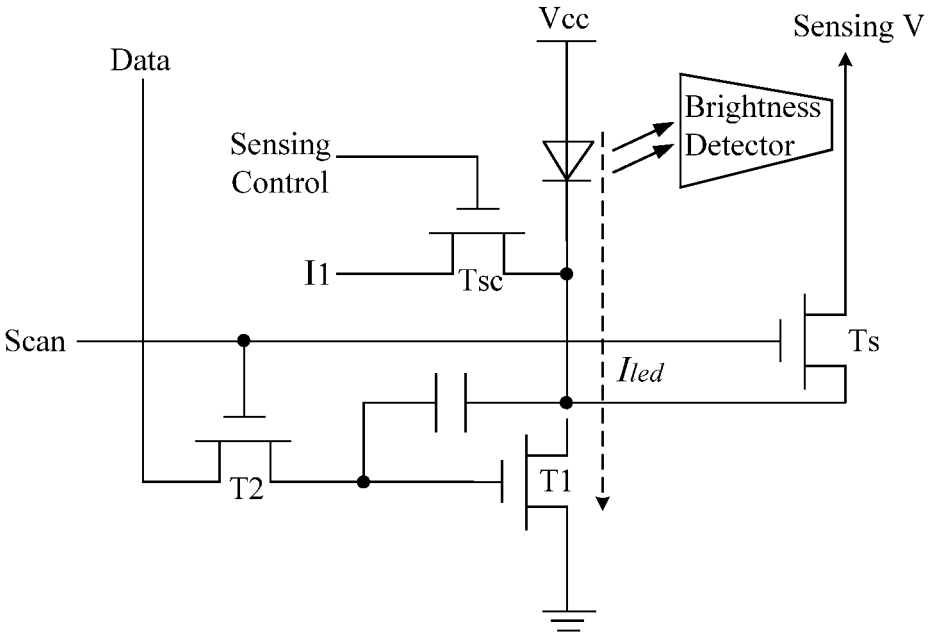
FIG. 8 is a schematic diagram of another LED driving circuit according to an embodiment of the disclosure.

Referring to FIG. 6, FIG. 7 and FIG. 8, FIG. 6 is a schematic diagram of a 2T1C driving circuit of an AM (also referred to as AM driving type) mini-LED according to an embodiment of the disclosure, FIG. 7 is a schematic diagram of a LED driving circuit according to an embodiment of the disclosure, and FIG. 8 is a schematic diagram of another LED driving circuit according to an embodiment of the disclosure.

Specifically, the embodiment of the disclosure provides an AM LED based display device 10, and each LED or each mini-LED pixel in the display device 10 has its own independent driving circuit. The driving circuit of each LED or each pixel uses at least two transistors to control an output current. The driving circuit may adopt the 2T1C driving circuit design of a basic pixel circuit architecture of AM mini-LED as shown in FIG. 6, and the architecture is relatively simple and easy to implement. In particular, a driving current of the driving circuit is provided by a driving transistor T1, the transistor T2 is used as a control transistor (also referred to as switching transistor) for controlling on-off of the pixel circuit, and the driving transistor T1 is electrically communicated with a power supply terminal Vcc to provide a stable current for the mini-LED.

In an embodiment of the disclosure, a LED driving circuit (see FIG. 7) may include a first transistor T1, a second transistor T2, a third transistor T3, a fourth transistor Tsc and a capacitor. A drain of the first transistor T1 and one terminal of the capacitor are electrically connected to a first reference node. A source of the second transistor T2, a gate of the first transistor T1 and the other terminal of the capacitor are electrically connected to a second reference node. A source of the first transistor T1, a source of the third transistor Ts and a source of the fourth transistor Ts are electrically connected to a third reference node. A gate of the second transistor T2 and a gate of the third transistor Ts are electrically connected to a fourth reference node. A drain of the second transistor T2 is electrically connected to a data signal input terminal Data of the AM mini-LED driving circuit. A drain of the third transistor Ts is electrically connected to a detection signal collecting/receiving terminal Sensing V. A drain of the fourth transistor Tsc is electrically connected to a detection current input terminal I1, and a gate of the fourth transistor Tsc is electrically connected to a detection control voltage terminal Sensing Control. The fourth reference node is electrically connected to a scan signal input terminal Scan of the AM mini-LED driving circuit. The LED is driven by the first transistor T1.

In the illustrated embodiment, a brightness detector is arranged beside the LED. The LED is a mini-LED. The LED driving circuit may be applied to the mini-LED based display device 10. The mini-LED based display device 10 includes, for example, a mini-LED display panel or a mini-LED backlight module of LCD.

In the illustrated embodiment, the first reference node is electrically connected to a voltage signal input terminal or a power supply terminal Vcc of the AM mini-LED driving circuit. The third reference node is electrically connected to an anode (positive electrode) of the LED, and a cathode (negative electrode) of the LED is electrically connected to a common electrode or a common ground electrode.

In the illustrated embodiment, a current detection may be performed onto the driving circuit before leaving the factory, so as to obtain the mapping relationship (e.g., in form of data table) between current and brightness. A process of performing the detection (also referred to as detection stage) may include: after the mini-LED based display device is produced/output, the fourth transistor Tsc of the driving circuit is used to acquire/collect data representing the mapping relationship between current and brightness of the LED; and during the brightness detector detects the brightness of the LED, signals on the detection control voltage terminal Sensing Control and the scan signal input terminal Scan of the AM mini-LED driving circuit are at logic high levels, a signal on the data signal input terminal Data of the AM mini-LED driving circuit is at a logic low level, the fourth transistor Tsc is turned on, the driving circuit control a current source to output currents into the detection current input terminal I1, and meanwhile the brightness detector measures brightness data of the LED. As a result, the data representing the mapping relationship between current and brightness shown in FIG. 2 and the data representing the mapping relationship between voltage and current shown in FIG. 3 are obtained.

In the illustrated embodiment, the driving circuit can, for example, perform real-time monitoring and compensation during operation. A process of monitoring and compensation (also referred to as compensation stage) includes: during the mini-LED based display device is in normal use, the third transistor Ts is used to acquire current data of the LED; and when the driving circuit is working, signals on the scan signal input terminal Scan of the AM mini-LED driving circuit, the data signal input terminal Data of the AM mini-LED driving circuit, and the voltage signal input terminal or the power supply terminal Vcc of the AM mini-LED driving circuit are at logic high levels, the first transistor T1, the second transistor T2 and the third transistor Ts all are turned on, and the detection signal receiving terminal Sensing V pulls out a voltage for calculating a LED brightness at that time; meanwhile the controller of the display device obtains a LED instant brightness according to the mapping relationship between brightness and current and the mapping relationship between brightness and time; and then the controller of the display device calculates a target voltage on the voltage signal input terminal or the power supply terminal Vcc of the AM mini-LED driving circuit by reading and referring to the mapping relationship between voltage and current and considering the brightness and then performs a voltage adjustment on the voltage signal input terminal or the power supply terminal Vcc of the AM mini-LED driving circuit according to the target voltage to achieve the compensation of brightness.

In another embodiment, referring to FIG. 8, and FIG. 8 is a schematic diagram of another LED driving circuit. Specifically, the first reference node, the source of the third transistor Ts and the source of the fourth transistor Tsc are electrically connected to the third reference node. The third reference node is electrically connected to the cathode of the LED, and the source of the first transistor T1 is electrically connected to the common electrode or a common ground electrode. The anode of the LED is electrically connected to the power supply terminal Vcc.

In the illustrated embodiment, a current detection may be performed onto the driving circuit before leaving the factory, so as to obtain the mapping relationship (e.g., in form of data table) between current and brightness. A process of performing the detection (also referred to as detection stage) may include: after the mini-LED based display device is produced/output, the fourth transistor Tsc of the driving circuit is used to acquire/collect data representing the mapping relationship between current and brightness of the LED; and during the brightness detector detects the brightness of the LED, signals on the detection control voltage terminal Sensing Control and the scan signal input terminal Scan of the AM mini-LED driving circuit are at logic high levels, a signal on the data signal input terminal Data of the AM mini-LED driving circuit is at a logic low level, the fourth transistor Tsc is turned on, the driving circuit control a current source to output currents into the detection current input terminal I1, and meanwhile the brightness detector measures brightness data of the LED. As a result, the data representing the mapping relationship between current and brightness shown in FIG. 2 and the data representing the mapping relationship between voltage and current shown in FIG. 3 are obtained.

In the illustrated embodiment, the driving circuit can, for example, perform real-time monitoring and compensation during operation. A process of monitoring and compensation (also referred to as compensation stage) includes: during the mini-LED based display device is in normal use, the third transistor Ts is used to acquire current data of the LED (i.e., data of currents $I_{led}$ flowing through the LED); and when the driving circuit is working, signals on the scan signal input terminal Scan of the AM mini-LED driving circuit, the data signal input terminal Data of the AM mini-LED driving circuit, and the voltage signal input terminal of the AM mini-LED driving circuit or the power supply terminal Vcc are at logic high levels, the first transistor T1, the second transistor T2 and the third transistor Ts all are turned on, and the detection signal receiving terminal Sensing V pulls out a voltage for calculating a LED brightness at that time; meanwhile the controller of the display device obtains a LED instant brightness according to the mapping relationship between brightness and current and the mapping relationship between brightness and time; and then the controller of the display device calculates a target voltage on the voltage signal input terminal or the power supply terminal Vcc of the AM mini-LED driving circuit by reading and referring to the mapping relationship between voltage and current and considering the brightness and then performs a voltage adjustment on the voltage signal input terminal or the power supply terminal Vcc of the AM mini-LED driving circuit according to the target voltage to achieve the compensation of brightness.

In still another embodiment, a display device as proposed adopts the method for maintaining LED brightness as shown in FIG. 1, or adopts the LED driving circuit as shown in FIG. 7 or FIG. 8, and it will not be repeated herein.

In the method for maintaining LED brightness, the driving circuit and the display device disclosed in the above embodiments, aiming at the influence of aging of the mini-LED over time, by detecting and storing data representing the mapping relationship between brightness and current, the mapping relationship between brightness and time and so on as shown in FIG. 2, FIG. 3 and FIG. 4 in the memory of the display device, and then compensating the LED brightness in a voltage compensation manner of the driving circuit as shown in FIG. 7 or FIG. 8, which realizes better control of LED display brightness, and thereby realizes the brightness compensation of each LED or each mini-LED pixel and consequently solves the problem of how to maintain the display brightness of the mass-produced AM mini-LEDs after long-term use.

Phrases such as "in this embodiment" and "in an embodiment of the disclosure" have been used repeatedly. The phrases usually do not refer to the same embodiment, but may also refer to the same embodiment instead. The terms "containing", "having" and "including" are synonymous, unless the context indicates other meanings.

The foregoing descriptions are only preferred embodiments of the invention, and do not limit the invention in any form. Although the invention has been disclosed by specific embodiments, it is not intended to limit the invention. Any skilled person in the art, without departing from the scope of the technical solutions of the invention, can make some changes or modifications as equivalent changes to obtain equivalent embodiments based on the technical content disclosed above. However, any simple amendment, equivalent change and modification made to the above embodiments according to the technical essence of the invention are still within the scope of the technical solutions of the invention.

What is claimed is:

1. A LED driving circuit comprising: a first transistor, a second transistor, a third transistor, a fourth transistor and a capacitor; wherein a drain of the first transistor and one terminal of the capacitor are electrically connected to a first reference node;

a source of the second transistor, a gate of the first transistor and the other terminal of the capacitor are electrically connected to a second reference node;

a source of the first transistor, a source of the third transistor and a source of the fourth transistor are electrically connected to a third reference node;

a gate of the second transistor and a gate of the third transistor are electrically connected to a fourth reference node;

a drain of the second transistor is electrically connected to a data signal input terminal;

a drain of the third transistor is electrically connected to a detection signal receiving terminal;

a drain of the fourth transistor is electrically connected to a detection current input terminal, and a gate of the fourth transistor is electrically connected to a detection control voltage terminal;

the fourth reference node is electrically connected to a scan signal input terminal; and a LED is driven by the first transistor.

2. The LED driving circuit as claimed in claim 1, wherein a brightness detector is arranged beside the LED, the LED is a mini-LED, the LED driving circuit is applied to a mini-LED based display device, and the mini-LED based display device comprises a mini-LED display panel or a mini-LED backlight module of a liquid crystal display device.

3. The LED driving circuit as claimed in claim 2, wherein the first reference node is electrically connected to a voltage signal input terminal, the third reference is electrically connected to an anode of the LED, and a cathode of the LED is electrically connected to a common ground electrode.

4. The LED driving circuit as claimed in claim 3, wherein the LED driving circuit is performed with a current detection before leaving factory to obtain a mapping relationship between current and brightness;

the current detection comprises: after the mini-LED based display device is produced, the fourth transistor of the LED driving circuit is used to acquire the mapping relationship between current and brightness;

during the brightness detector is used to detect brightness of the LED, signals on the detection control voltage terminal and the scan signal input terminal are at logic high levels respectively, a signal on the data signal input terminal is at a logic low level, the fourth transistor is turned on, the LED driving circuit controls a current source outputs currents to flow through the LED, and meanwhile the brightness detector measures data of brightness of the LED, and thereby the mapping relationship between current and brightness and a mapping relationship between voltage and current are obtained.

5. The LED driving circuit as claimed in claim 3, wherein the LED driving circuit is performed with a real-time monitoring and compensation when it is normally working;

the real-time monitoring and compensation comprise: during the mini-LED based display device is in normal use, the third transistor is used to acquire data of currents of the LED;

during the LED driving circuit is normally working, signals on the scan signal input terminal, the data signal input terminal and the voltage signal input terminal are at logic high levels respectively, the first transistor, the second transistor and the third transistor all are turned on, the detection signal receiving terminal pulls out a voltage for calculating brightness of the LED, a controller of the mini-LED based display device meanwhile calculates instant brightness according to a mapping relationship between current and brightness and a mapping relationship between brightness and time, and the controller calculates a target voltage by reading and referring to a mapping relationship between voltage and current and considering the instant brightness and then adjusts a voltage on the voltage signal input terminal according to the target voltage to achieve the compensation.

6. The LED driving circuit as claimed in claim 2, wherein the first reference node, the source of the third transistor and the source of the fourth transistor are electrically connected to the third reference node;

the third reference node is electrically connected to a cathode of the LED, and an anode of the LED is electrically connected to a voltage signal input terminal; and the source of the first transistor is electrically connected to a common ground electrode.

7. The LED driving circuit as claimed in claim 6, wherein the LED driving circuit is performed with a current detection before leaving factory to obtain a mapping relationship between current and brightness;

the current detection comprises: after the mini-LED based display device is produced, the fourth transistor of the LED driving circuit is used to acquire the mapping relationship between current and brightness;

during the brightness detector is used to detect brightness of the LED, signals on the detection control voltage terminal and the scan signal input terminal are at logic high levels respectively, a signal on the data signal input terminal is at a logic low level, the fourth transistor is turned on, the LED driving circuit controls a current source outputs currents to flow through the LED, and meanwhile the brightness detector measures data of brightness of the LED, and thereby the mapping relationship between current and brightness and a mapping relationship between voltage and current are obtained.

8. The LED driving circuit as claimed in claim 6, wherein the LED driving circuit is performed with a real-time monitoring and compensation when it is normally working;

the real-time monitoring and compensation comprise: during the mini-LED based display device is in normal use, the third transistor is used to acquire data of currents of the LED;

during the LED driving circuit is normally working, signals on the scan signal input terminal, the data signal input terminal and the voltage signal input terminal are at logic high levels respectively, the first transistor, the second transistor and the third transistor all are turned on, the detection signal receiving terminal pulls out a voltage for calculating brightness of the LED, a controller of the mini-LED based display device meanwhile calculates instant brightness according to a mapping relationship between current and brightness and a mapping relationship between brightness and time, and the controller calculates a target voltage by reading and referring to a mapping relationship between voltage and current and considering the instant brightness and then adjusts a voltage on the voltage signal input terminal according to the target voltage to achieve the compensation.

9. A display device comprising a LED driving circuit and a LED, wherein the LED driving circuit comprises: a first transistor, a second transistor, a third transistor, a fourth transistor and a capacitor;

a drain of the first transistor and one terminal of the capacitor are electrically connected to a first reference node;

a source of the second transistor, a gate of the first transistor and the other terminal of the capacitor are electrically connected to a second reference node;

a source of the first transistor, a source of the third transistor and a source of the fourth transistor are electrically connected to a third reference node;

a gate of the second transistor and a gate of the third transistor are electrically connected to a fourth reference node;

a drain of the second transistor is electrically connected to a data signal input terminal;

a drain of the third transistor is electrically connected to a detection signal receiving terminal;

a drain of the fourth transistor is electrically connected to a detection current input terminal, and a gate of the fourth transistor is electrically connected to a detection control voltage terminal;

the fourth reference node is electrically connected to a scan signal input terminal; and the LED is driven by the first transistor.

10. The display device as claimed in claim 9, wherein a brightness detector is arranged beside the LED, the LED is a mini-LED, the display device is a mini-LED based display device, and the mini-LED based display device comprises a mini-LED display panel or a mini-LED backlight module of a liquid crystal display device.

11. The display device as claimed in claim 10, wherein the first reference node is electrically connected to a voltage signal input terminal, the third reference is electrically connected to an anode of the LED, and a cathode of the LED is electrically connected to a common ground electrode.

12. The display device as claimed in claim 11, wherein the LED driving circuit is performed with a current detection before leaving factory to obtain a mapping relationship between current and brightness;

the current detection comprises: after the mini-LED based display device is produced, the fourth transistor of the LED driving circuit is used to acquire the mapping relationship between current and brightness;

during the brightness detector is used to detect brightness of the LED, signals on the detection control voltage terminal and the scan signal input terminal are at logic high levels respectively, a signal on the data signal input terminal is at a logic low level, the fourth transistor is turned on, the LED driving circuit controls a current source outputs currents to flow through the LED, and meanwhile the brightness detector measures data of brightness of the LED, and thereby the mapping relationship between current and brightness and a mapping relationship between voltage and current are obtained.

13. The display device as claimed in claim 11, wherein the LED driving circuit is performed with a real-time monitoring and compensation when it is normally working;

the real-time monitoring and compensation comprise: during the mini-LED based display device is in normal use, the third transistor is used to acquire data of currents of the LED;

during the LED driving circuit is normally working, signals on the scan signal input terminal, the data signal input terminal and the voltage signal input terminal are at logic high levels respectively, the first transistor, the second transistor and the third transistor all are turned on, the detection signal receiving terminal pulls out a voltage for calculating brightness of the LED, a controller of the mini-LED based display device meanwhile calculates instant brightness according to a mapping relationship between current and brightness and a mapping relationship between brightness and time, and the controller calculates a target voltage by reading and referring to a mapping relationship between voltage and current and considering the instant brightness and then adjusts a voltage on the voltage signal input terminal according to the target voltage to achieve the compensation.

14. The display device as claimed in claim 10, wherein the first reference node, the source of the third transistor and the source of the fourth transistor are electrically connected to the third reference node;

the third reference node is electrically connected to a cathode of the LED, and an anode of the LED is electrically connected to a voltage signal input terminal; and the source of the first transistor is electrically connected to a common ground electrode.

15. The display device as claimed in claim 14, wherein the LED driving circuit is performed with a current detection before leaving factory to obtain a mapping relationship between current and brightness;

the current detection comprises: after the mini-LED based display device is produced, the fourth transistor of the LED driving circuit is used to acquire the mapping relationship between current and brightness;

during the brightness detector is used to detect brightness of the LED, signals on the detection control voltage terminal and the scan signal input terminal are at logic high levels respectively, a signal on the data signal input terminal is at a logic low level, the fourth transistor is turned on, the LED driving circuit controls a current source outputs currents to flow through the LED, and meanwhile the brightness detector measures data of brightness of the LED, and thereby the mapping relationship between current and brightness and a mapping relationship between voltage and current are obtained.

16. The display device as claimed in claim 14, wherein the LED driving circuit is performed with a real-time monitoring and compensation when it is normally working;

the real-time monitoring and compensation comprise: during the mini-LED based display device is in normal use, the third transistor is used to acquire data of currents of the LED;

during the LED driving circuit is normally working, signals on the scan signal input terminal, the data signal input terminal and the voltage signal input terminal are at logic high levels respectively, the first transistor, the second transistor and the third transistor all are turned on, the detection signal receiving terminal pulls out a voltage for calculating brightness of the LED, a controller of the mini-LED based display device meanwhile calculates instant brightness according to a mapping relationship between current and brightness and a mapping relationship between brightness and time, and the controller calculates a target voltage by reading and referring to a mapping relationship between voltage and current and considering the instant brightness and then adjusts a voltage on the voltage signal input terminal according to the target voltage to achieve the compensation.

* * * * *